US005083069A

United States Patent [19]

Jimenez et al.

[11] Patent Number: 5,083,069

[45] Date of Patent: Jan. 21, 1992

[54] CONTROL PEDAL FOR AN ELECTRIC MACHINE

[75] Inventors: Antonio Jimenez, Meyrin; Michel Combepine, Les Avanchets, both of Switzerland

[73] Assignee: Mefina S.A., Fribourg, Switzerland

[21] Appl. No.: 659,448

[22] Filed: Feb. 22, 1991

Related U.S. Application Data

[63] Continuation of Ser. No. 439,469, Nov. 21, 1989, abandoned.

[30] Foreign Application Priority Data

Nov. 28, 1988 [CH] Switzerland ..... 4412/88

[51] Int. Cl.[5] ..... D05B 69/18

[52] U.S. Cl. ..... 318/558; 338/153; 200/332.2; 112/275

[58] Field of Search ..... 318/488, 558; 200/86.5, 200/322, 332, 332.1, 332.2; 338/108, 110, 153; 112/104, 217.3, 217.4, 274, 275, 277, 258; 74/512, 513, 514

[56] References Cited

U.S. PATENT DOCUMENTS

| | | | |
|---|---|---|---|
| 1,728,004 | 9/1929 | Norris | 338/153 |
| 2,192,714 | 3/1940 | Norman et al. . | |
| 2,644,868 | 7/1953 | Locey | 200/86.5 X |
| 2,822,441 | 2/1958 | Fortney | 299/86.5 |
| 2,846,552 | 8/1958 | Winz . | |
| 2,944,120 | 7/1960 | Ruben | 200/86.5 X |
| 3,427,545 | 2/1969 | Tanzman . | |
| 3,898,542 | 8/1975 | Current | 338/108 X |
| 3,916,722 | 11/1975 | Grobe | 200/86.5 X |
| 4,283,612 | 8/1981 | Richards | 200/86.5 X |
| 4,290,042 | 9/1981 | Sato | 338/113 |
| 4,296,702 | 10/1981 | Meier et al. | 112/258 |
| 4,496,811 | 1/1985 | Irwin | 200/86.5 |

*Primary Examiner*—Bentsu Ro
*Attorney, Agent, or Firm*—Young & Thompson

[57] ABSTRACT

The control pedal (7) for an electric machine (3) comprises a movable member (9) connected to a foot support (11) and adapted to be actuated by the foot of the user, whose heel rests on the plate (10). When the pedal (7) is not in use, the member (9) may be lowered against the plate (10), whereas the cord (8) and that which is provided for the plug (6), are wound about the portions (12) forming bobbins.

6 Claims, 2 Drawing Sheets

CONTROL PEDAL FOR AN ELECTRIC MACHINE

This application is a continuation of application Ser. No. 07/439,469, filed Nov. 21, 1989, now abandoned.

Control pedals for electric machines are known, especially for sewing machines, comprising a housing and a movable member adapted to be actuated by the foot of the user, this member acting on a variable electric element permitting the operating and the adjustment of the speed of the machine, an electric cord being provided to connect the pedal to the machine.

The present invention has as an object to render pedals of this type more practical to use.

To this end, the pedal forming the object of the invention is characterized in that the said member is in the form of a handle capable of occupying two positions, one of which is used for transporting the pedal, and the other of which is used to control the speed of the machine.

The accompanying drawing shows schematically and by way of non-limiting example, an embodiment of the pedal according to the invention.

Figure 1:
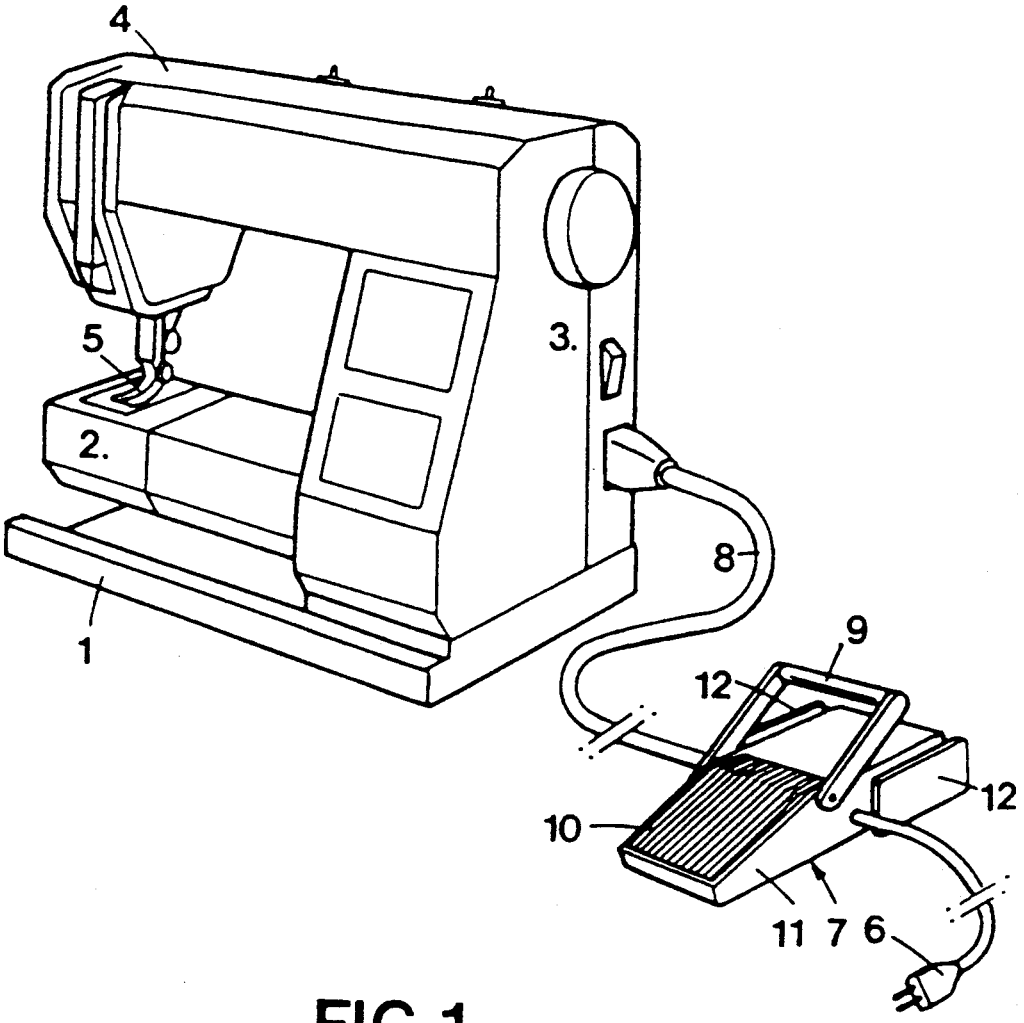
FIG. 1 shows a sewing machine equipped with this pedal.

The sewing machine shown in FIG. 1 comprises in the normal manner a base plate 1, a lower arm 2, an upright 3 and an upper arm 4 carrying a presser foot 5.

Energization of this electric machine is effected by means of a plug 6 intended to be engaged in an electrical outlet, current being supplied to the control pedal 7, which is connected by an electric cord 8 to the electric motor of the sewing machine.

The pedal 7 has a movable member 9 intended to be actuated by the foot of the user, whose heel normally rests on a support plate 10. This member 9 permits operating the machine and regulating its sewing speed.

The pedal 7 comprises a housing 11 and, on each of two side faces of this housing, a portion 12 forming a bobbin for permitting the winding thereon of the cord carrying the plug 6, and the cord 8, respectively.

Figure 2:
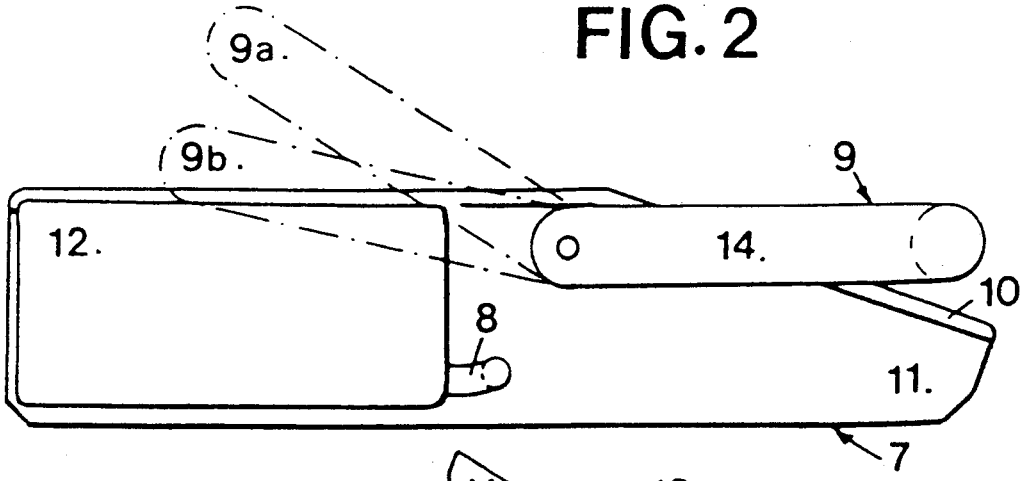
FIG. 2 is a side view of this pedal.

FIG. 2 shows the pedal 7 in its non-use position, in which the member 9, which is in the form of a handle, is lowered above the plate 10. It can also be seen that the electric cord 8 has been wound about its portion forming a bobbin. Finally, FIG. 2 also shows, in phantom line, the two extreme positions of the member 9 for position of use, namely the position 9*a* corresponding to stoppage of the machine and the position 9*b* corresponding to its maximum speed.

Figure 3:
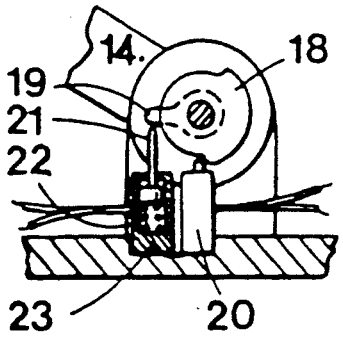
FIG. 3 shows in detail a portion of the interior mechanism of the pedal.
Figure 4:
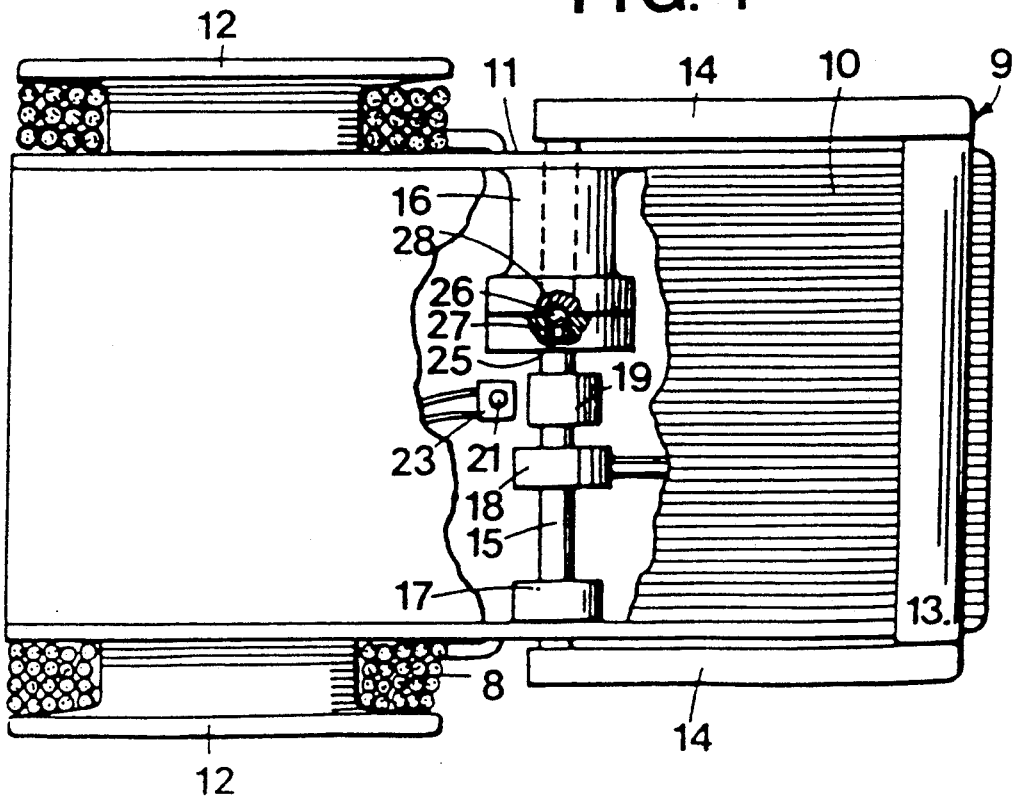
FIG. 4 is a plan view of this pedal, partially broken away.

As shown in FIGS. 3 and 4, the movable member 9 is U-shaped and comprises a central piece 13 and two side pieces 14, the free ends of these latter being interconnected by a rod 15. This rod pivots in bearing sleeves 16 and 17 integral with the side walls of the housing 11.

The rod 15 carries two cams 18 and 19.

The cam 18 acts on a switch 20 and its adapted to act on the switch so as to cut off the supply of electricity to the machine, as soon as the member 9 is moved from its position 9*a* to be brought into its position permitting transport and positioning of the pedal when it is not used. There is thus obtained greater security permitting preventing any untimely turning on of the machine, for example in the case of a defect in an electric element for energizing the motor.

The other cam 19 has the shape of a finger extending to act on a pin 21, such as a potentiometer, this pin being biassed upwardly by a spring 22 confined in a housing 23.

It should be noted that the rod 15 also carries a disc 24 having a blind bore 25, in which is housed a ball 26 subjected to the action of a spring 27, which ball is in meshing engagement with a socket 28 of the sleeve 16.

This device forms an elastic catch for maintaining the member 9 in its transport position.

The control pedal has been described with reference to an application to a sewing machine, but it goes without saying that it may also be applied to any apparatus or machines whose operation is controlled with the aid of a control pedal.

In any manner, it is possible to provide numerous variations of manufacture, and, in the case where the machine is supplied directly from the electrical outlet, a single electric cord is necessary to connect the pedal to the sewing machine.

We claim:

1. Control pedal for an electric machine, comprising a housing and a U-shaped handle having free ends pivotally mounted on the housing for swinging movement of the handle relative to the housing between two positions, one of which is used for transporting the pedal and the other of which is used for operating and controlling the speed of an electric machine connected to the pedal by an electric cord, a variable electric element in the housing that permits the operation and adjustment of the speed of the machine, said variable electric responding to swinging movement of the handle relative to the housing, in said other position, to operate and control the speed of the machine, the U-shaped handle in said one position having a central portion spaced from said housing a distance sufficient to permit the hand of a user to grasp said central portion to transport said control pedal.

2. Control pedal according to claim 1, characterized in that the handle acts on a switch intended to disconnect the electric element when the handle is placed in its transporting position.

3. Control pedal according to claim 1 further comprises means for mounting said free ends on said housing for swinging movement of said handle relative to said housing about an axis passing through said free ends, and wherein said variable electric element comprising potentiometer means for supplying power to said machine in proportion to the swung position of said handle relative to said housing about said axis.

4. Control pedal according to claim 1 further comprises a heel plate carried by said housing for supporting the heel of the user, said heel plate being inclined upwardly away from the user, said central portion of said handle in said one position overlying but being spaced above said heel plate, said handle in said other position extending beyond said heel plate and being inclined upwardly away from the user.

5. Control pedal for an electric machine, comprising a housing and a movable member adapted to be actuated by the foot of a user, this member acting on a variable electric element permitting operation and adjustment of the speed of the machine, an electric cord being provided to connect the pedal to the machine, characterized in that said member is in the form of a handle adapted to occupy two positions, one of which is used for transporting the pedal and the other of which is used for operating and controlling the speed of the machine, said handle in said one position having a central handle portion spaced from said housing a distance sufficient to permit the hand of the user to grasp said central handle portion to transport said control pedal, a switch on which the handle acts to disconnect the electric element when the handle is placed in its transporting position, the handle being generally U-shaped and having free ends that are connected to the housing, and an elastic catch for maintaining the handle in its transportation position.

6. Control pedal for an electric machine comprising a housing and a movable member adapted to be actuated by the foot of a user, this member acting on a variable electric element permitting operation and adjustment of the speed of the machine, an electric cord being provided to connect the pedal to the machine, characterized in that said member is in the form of a handle adapted to occupy two positions, one of which is used for transporting the pedal and the other of which is used for operating and controlling the speed of the machine, said handle in said one position having a central handle portion spaced from said housing a distance to permit the hand of the user to grasp said central handle portion to transport said control pedal, wherein the housing has on one of its exterior faces at least one portion forming a bobbin, permitting the winding thereon of the electric cord when the pedal is not in use.

* * * * *